US005651624A

United States Patent [19]

Passer

[11] Patent Number: 5,651,624

[45] Date of Patent: Jul. 29, 1997

[54] APPARATUS FOR RECEIPT PRINTING HAVING SHARED PATHWAY WITH CHECK VALIDATION

[75] Inventor: Barry E. Passer, Newfield, N.Y.

[73] Assignee: Axiohm IPB Inc., Ithaca, N.Y.

[21] Appl. No.: 594,979

[22] Filed: Jan. 31, 1996

[51] Int. Cl.[6] ..... B41J 11/50

[52] U.S. Cl. ..... 400/605; 400/599; 400/607.2; 400/693

[58] Field of Search ..... 400/605, 607, 400/607.2, 608, 608.1, 608.2, 608.3, 621, 599, 693

[56] References Cited

U.S. PATENT DOCUMENTS 5,219,236 6/1993 Kamimura et al. ..... 400/607.2
5,472,287 12/1995 Hasegawa et al. ..... 400/605

*Primary Examiner*—Ren Yan
*Attorney, Agent, or Firm*—Salzman & Levy

[57] ABSTRACT

The present invention features a receipt printing and check validating machine. The machine is characterized by a drop-in loading for the receipt paper supply roll. A first drive roller for the receipt printer is pivotably mounted in a clamshell bucket. The first drive roller is swung into contact, when the clamshell bucket is closed, with an idler roller centrally mounted on a fixedly-mounted idler/drive combination shaft. The check validating drive features a second, slip drive roller pair that is in pivotable contact with a pair of slip drive rollers mounted on the aforementioned fixedly-mounted idler/drive combination shaft, one on either side of the receipt idler roller. Thus, the idler/drive combination roller shaft has a fixed position with respect to both drive rollers, and is used cooperatively by both drive rollers. Both the check and the receipt can emerge from the same slot in the housing of the machine.

17 Claims, 2 Drawing Sheets

APPARATUS FOR RECEIPT PRINTING HAVING SHARED PATHWAY WITH CHECK VALIDATION

FIELD OF THE INVENTION

The present invention relates to retail receipt printing mechanisms, and more particularly to a retail receipt printer that shares a common pathway with a check validation drive, whereby the printing and validation operations are part of a shared drive system that mutually uses the same idler/drive combination shaft component.

BACKGROUND OF THE INVENTION

It has recently become useful to validate customer checks at retail establishments and shopping markets. Small desk top or counter top machines are used commercially to print receipts for transactions, and to validate customer checks. One such machine is a Model No. 7221 printer manufactured by Axiohm Corporation, Ithaca, N.Y.

Machines of this type usually have separate pathways, and separate pairs of drive and idler rollers (or undriven, pressure rollers) for each operation. That is, the validation drive has separate drive and idler rollers apart from the drive and idler rollers of the receipt printer. In other words, at least four rollers on separate shafts are normally required to provide both functions in one machine.

A customer check to be validated is normally fed into the above-identified machine by a stepper motor drive unit. The check is driven into the machine along its own pathway until all of its magnetic ink numbers have passed a magnetizing unit. Then the stepper motor is reversed, and the machine discharges the check at constant speed. During the discharge phase, the magnetized ink numbers on the check surface pass a magnetic read head, and are read and decoded. A print operation can also be implemented during this cycle.

A receipt, on the other hand, is printed in the above-identified machine by drop-in loading a roll of paper into a supply paper receiving bucket. The paper is directed along its own pathway past a print head and, optionally, a cutting blade. The printed receipt of a sales transaction emerges through its own slot in the housing of the machine.

The two separate printing and validating operations described above require two sets or pairs of drive roller shafts, two separate slots, and two separate feed paths.

In conventional inserted forms or "slip" printing/check validating type machines, the slip feed rollers must be located a predetermined distance below the print head. However, in a drop-in loading scheme, as with the present invention, the paper must pass over the pair of slip feed rollers. In other commercial printers in which the receipt paper has a narrow width and the checks or other forms to be validated are wider, the slip feed rollers may straddle the receipt. The receipt paper passes between the slip feed shafts. This configuration, however, prevents drop-in loading of the supply paper.

In other printing machines, the paper is detoured over the slip feed rollers. However, the receipt drive roller pair is not positioned next to the platen, and is incapable of pushing receipt paper around the slip rollers and platen without a second set of receipt rollers. The second set of receipt rollers is therefore necessary to prevent paper buckling and print head jamming. Once again, the second set of rollers is also a deterrent for the drop-in loading of the supply paper.

The present invention features a configuration that can permit a single check validating and receipt slot in the housing or cover of the receipt printing and check validating machine, although two, separate slots in the housing or cover can be incorporated without departing from the scope Of the invention. A fixedly positioned idler and drive combination shaft is flanked by two pivotable drive rollers, each of which drive rollers moves its respective receipt paper and check along a common drive path. During a check validating operation, a customer's check is inserted in the slot, and is driven past a magnetizing unit by a first, slip drive roller in contact with both rollers on the idler/drive combination shaft. During the sales receipt printing phase, the paper from the drop-in supply roll is driven past a printer and cutting blade by a second, receipt drive roller in contact with the idler roller that is mounted on the idler/drive combination shaft, and emerges through the same slot. The receipt drive roller is mounted on a clamshell bucket. The idler roller and the drive roller are used cooperatively in order to control and advance the receipt paper.

In other words, these two separate operations now share the same idler/drive combination shaft. The invention, therefore, has reduced the number of drive and idler roller shafts from four to three. In addition, the two separate operations can share the same pathway, and can operate through the same slot in the housing and cover. This allows the design of the machine to become more compact and less expensive than conventional machines.

The present invention has as one of its objectives to provide an improved check validating and receipt printing machine.

Another objective is to provide a compact and low-cost slip printing and check validating machine.

Yet a further objective is to provide a check validating and receipt printing machine that has less parts than conventional machines performing the same functions.

Still a further objective is to provide a machine for receipt printing and check validating that allows for drop-in loading of the receipt paper supply roll, and for complete exposure of the receipt path for jam clearance and other maintenance procedures performed in a straightforward manner.

SUMMARY OF THE INVENTION

In accordance with the present invention, there is provided a receipt printing and check validating machine. The machine is characterized by a drop-in loading for the receipt paper supply roll. A first drive roller for the receipt printer is pivotably mounted a clamshell cover or bucket. The first drive roller is swung into contact, when the clamshell bucket is closed, with an idler roller centrally mounted on a fixedly-mounted idler/drive combination shaft. The check validating drive features a second, slip drive roller pair that is in pivotable contact with a pair of slip drive rollers mounted on the aforementioned fixedly-mounted idler/drive combination shaft, one on either side of the receipt idler roller. Thus, the idler/drive combination shaft has a fixed position with respect to both drive rollers. Portions of the rollers mounted on this combination shaft are used cooperatively by both drive rollers. Both the check and the receipt can emerge from the same slot in the housing of the machine.

BRIEF DESCRIPTION OF THE DRAWINGS

A complete understanding of the present invention may be obtained by reference to the accompanying drawings, when considered in conjunction with the subsequent detailed description, in which.

DESCRIPTION OF THE PREFERRED EMBODIMENT

Generally speaking, the invention features a receipt printing and check validating machine. The machine is characterized by its drop-in receipt paper supply roll, and a common pathway that may be used for both the receipt printing operation, and the check validation function. Both the printing and the validation procedures share the same idler/drive combination shaft and may also share the same discharge slot in the cover of the machine.

Figure 1:
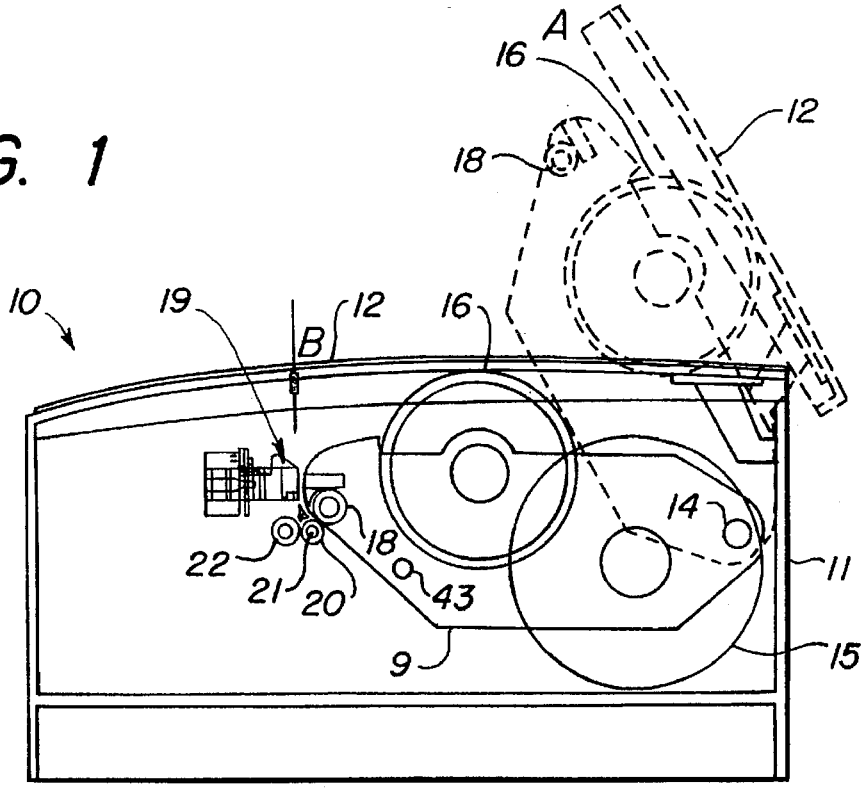
FIG. 1 illustrates a side, internal view of the receipt printing, check validating machine of this invention, with the clamshell bucket and the cover shown in their open and closed pivot positions.

Now referring to FIG. 1, the check validation and receipt printing machine 10 of this invention is shown. The machine 10 comprises a housing 11, upon which a clamshell type bucket 9 is pivotably mounted about pivot point 14. An outside cover 12 is hingedly mounted to the housing 11 to protect the printing, reading and roller mechanisms. The clamshell bucket 9 and cover 12 are shown in phantom in their open position A, and shown in solid line in its closed position B. In the open position A, a receipt paper supply roll 15 is dropped into the clamshell bucket 9 in the housing 11.

Rotationally mounted to the clamshell bucket 9 is a journal take-up roll 16, which receives a printed receipt log of the print receipt transactions. Also rotationally mounted to the clamshell bucket 9 is a receipt printing drive roller 18, that is used to drive the receipt paper web 28 (FIG. 3) from the receipt supply paper roll 15, past a print head 19. The receipt printing drive roller 18 pivots about pivot point 43, and in the closed cover position B comes into driving contact with an idler roller 20.

Figure 2:
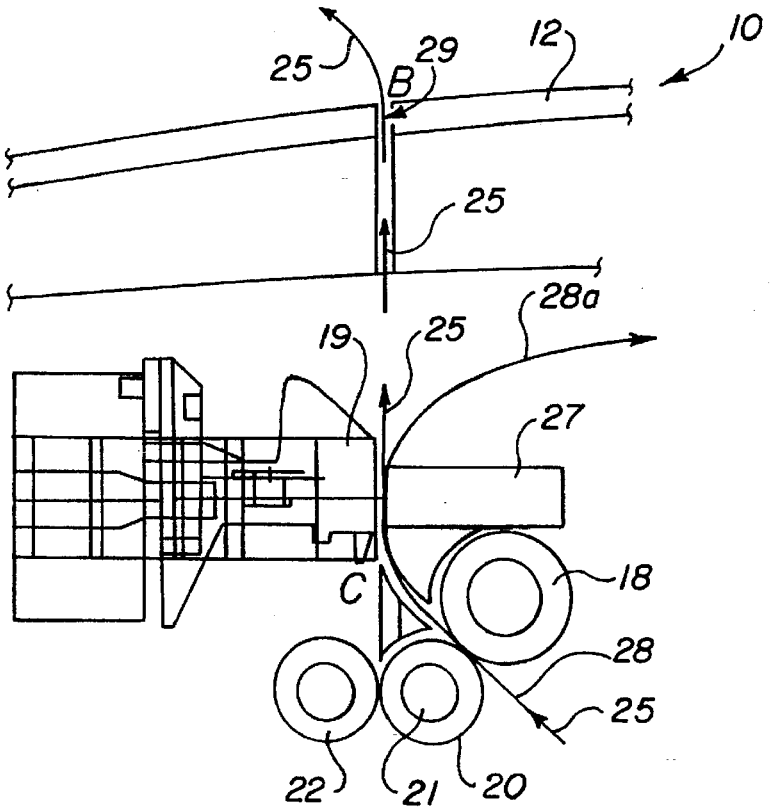
FIG. 2 depicts an enlarged internal view of the common pathway and the two pairs of drive rollers in contact with the rollers mounted on the common idler/drive combination shaft.
Figure 3:
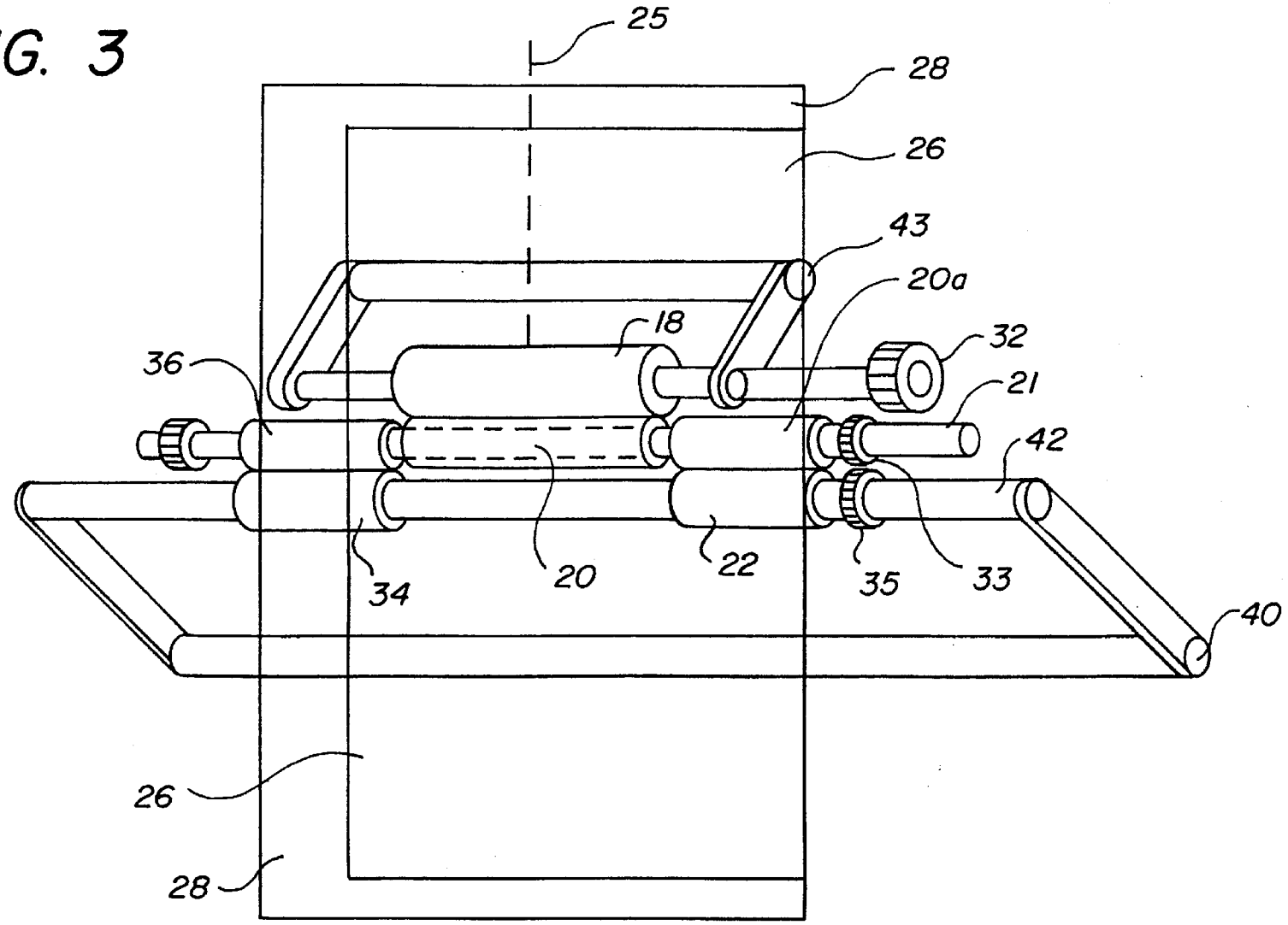
FIG. 3 shows a perspective view of the pivoting drive rollers in contact with the common idler/drive combination shaft.

The idler roller 20 is rotationally mounted upon an idler/drive combination shaft 21, best shown in FIG. 3, which has a fixed position with respect to a pair of slip drive rollers 22 and 34 that drive a check being validated. The validation slip drive rollers 22 and 34 are also in pivotable contact with respective slip drive rollers 20*a* and 36 mounted on either side of the idler roller 20, as shown. Slip drive rollers 20*a* and 36 are attached to, and idler roller 20 is supported by, idler/drive combination shaft 21. Both the personal check and the receipt paper are shown with respect to their respective drive roller pairs 22, 34 and 20*a*, 36 (check validation rollers); and drive/idler roller pairs 18 and 20 (receipt rollers), with reference to FIGS. 2 and 3, as explained hereinafter.

Referring now also to FIG. 2, an enlarged view of the feed mechanism of FIG. 1 is shown. A feed pathway for the receipt paper web 28 is illustrated by arrows 25. The receipt paper web 28 from supply roll 15 (FIG. 1) is driven along pathway 25 as it is grabbed between receipt drive roller 18 and receipt idler roller 20. The receipt for the customer is printed as it moves past the print head 19 and the adjacent platen 27. The customer's receipt then emerges from the slot 29 in the cover 12 of machine 10. A journal record of all of the sales (receipt) transactions is printed on a separate duplicate receipt paper web 28*a*, and is then stored on take-up roll 16, as depicted in FIG. 1.

The pathway that validates the customer's personal check 26 (FIG. 3) can share the same pathway 25, and the same slot 29, as does the receipt paper 28. The check 26 is fed into slot 29, right justified, as shown in FIG. 3, and is driven downwardly past a magnetizing unit and magnetic reader (not shown), by the two pairs of slip drive rollers 22, 34 and 20*a*, 36, respectively. The validation pathway branches from the common pathway 25 for the receipt 28, at point C, and then proceeds directly downward to enter between the respective slip drive rollers, described above. The check 26 is then run past the magnetizing unit (not shown), and then the rotation of the shaft 21 is reversed. The check 26 is validated by a magnetic reader (not shown), as the shaft 21 reverses to discharge the check 26. The validated check 26 then emerges through slot 29.

Referring now also to FIG. 3, a perspective view of the drive mechanism for the check 26 and receipt paper 28 is shown. The check 26 and receipt paper 28 move along a common pathway until each article branches to respective driven rollers 20*a*, 36 and 18. As aforementioned, the printing receipt drive roller 18 is in pivotal contact with the centrally positioned receipt idler roller 20, via pivot point 43. The printing receipt drive roller 18 is powered through receipt drive gear 32. The receipt idler roller 20 is rotationally mounted on shaft 21, which is positionally fixed, as shown. The check 26, being narrower than the receipt 28, is fed between the nip of the slip drive rollers 20*a* and 22. A pair of slip rollers 34, 36, respectively, are rotationally mounted on the opposite side from the pair of slip drive rollers 22, 20*a*, in order to balance the driving forces and prevent skewing of the check 26. A slip drive gear 33 engages with gear 35 to power the slip drive rollers 22, 20*a*, and the slip drive rollers 34, 36, respectively. The rollers 22 and 34 are attached to drive shaft 42, which pivots about pivot point 40.

As can be observed from the above description of the apparatus, both the check 26 and the receipt paper 28 share the same idler/drive combination shaft 21. Moreover, both articles may also share a common pathway 25 and a common discharge slot 29, but need not share the pathway 25 and slot 29 in alternate embodiments, not shown.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A check validation and receipt printing machine having a clamshell configuration, comprising:

a housing for containing a drive apparatus;

means defining a pathway for a customer receipt and a customer personal check;

said drive apparatus including:

a first drive roller pair including an idler roller engaging with a web of receipt paper traveling along said pathway, and driving said web of receipt paper;

an independently-driven second bidirectional drive roller pair for engaging with and driving said customer personal check along said pathway, in order to validate said customer personal check;

a common idler/drive combination shaft, including said idler roller, mounted between said respective first and second drive rollers, said first and second drive rollers sharing said idler/drive combination shaft in common in driving the respective receipt paper web and the customer personal check along said pathway.

2. The check validation and receipt printing machine in accordance with claim 1, further comprising means defining a common slot in said housing through which both the customer receipt and the customer personal check are discharged from said housing.

3. The check validation and receipt printing machine in accordance with claim 1, wherein said check validation and receipt printing machine is characterized by a drop-in receipt paper supply roll.

4. The check validation and receipt printing machine in accordance with claim 1, further comprising a clamshell bucket for said housing.

5. The check validation and receipt printing machine in accordance with claim 4, wherein said clamshell bucket supports said first drive roller.

6. The check validation and receipt printing machine in accordance with claim 1, further comprising receipt paper web cutting means disposed along said pathway for at least partially severing said web of receipt paper.

7. An inserted form validation and receipt printing machine, characterized by having a drop-in receipt paper supply roll, said inserted form validation and receipt printing machine comprising:

a housing for containing a drive apparatus and a drop-in receipt paper supply roll;

means defining a first pathway for a customer receipt and a second pathway for an inserted form;

said drive apparatus including:

a first drive roller pair including an idler roller for engaging with a web of receipt paper traveling along said first pathway, and driving said web of receipt paper;

an independently-driven second bidirectional drive roller pair for engaging with and driving said inserted form along said second pathway, in order to validate said inserted form;

a common idler/drive combination shaft, including said idler roller, mounted between said respective first and second drive rollers, said first and second drive rollers sharing said idler/drive combination shaft in common in driving the respective receipt paper web and the inserted form along each of said respective pathways.

8. The inserted form validation and receipt printing machine in accordance with claim 7, further comprising means defining at least one slot in said housing through which both the customer receipt and the inserted form are discharged from said housing.

9. The inserted form validation and receipt printing machine in accordance with claim 7, further comprising a clamshell bucket for said housing.

10. The inserted form validation and receipt printing machine in accordance with claim 7, wherein said clamshell bucket supports said first drive roller.

11. The inserted form validation and receipt printing machine in accordance with claim 7, further comprising receipt paper web cutting means disposed along said first pathway for at least partially severing said web of receipt paper.

12. A form validation and receipt printing machine having a drop-in receipt paper supply roll, the receipt and form of which share a common idler/drive combination shaft, said form validation and receipt printing machine comprising:

a housing for containing a drive apparatus and a drop-in receipt paper supply roll;

means defining at least one pathway for a customer receipt and a form;

said drive apparatus including:

a first drive roller pair including an idler roller for engaging with a web of receipt paper traveling along said at least one pathway, and driving a web of receipt paper;

an independently-driven second bidirectional drive roller pair for engaging with and driving said form along said at least one pathway, in order to validate said form;

a common idler/drive combination shaft, including said idler roller, disposed between said respective first and second drive rollers, said first and second drive rollers sharing said idler/drive combination shaft in common in driving the respective web of receipt paper and the form along said at least one pathway; and means defining at least one slot disposed along each of said at least one pathway in said housing through which both the customer receipt and the form are discharged from said housing by said drive apparatus.

13. The form validation and receipt printing machine in accordance with claim 12, further comprising a clamshell bucket for said housing.

14. The form validation and receipt printing machine in accordance with claim 12, wherein said clamshell bucket supports said first drive roller.

15. The form validation and receipt printing machine in accordance with claim 12, further comprising receipt paper web cutting means disposed along said pathway for at least partially severing said web of receipt paper.

16. The form validation and receipt printing machine in accordance with claim 15, further comprising printing means disposed along said pathway for printing on said web of receipt paper.

17. The form validation and receipt printing machine in accordance with claim 16, wherein said printing means comprises an impact print head.

* * * * *